US005383319A

United States Patent [19]

Sörqvist

[11] Patent Number: 5,383,319

[45] Date of Patent: Jan. 24, 1995

[54] METHOD OF ERECTING A FOUNDATION STRUCTURE FOR A BUILDING SUBSTRUCTURE

[76] Inventor: Stig Sörqvist, Pl. 2790, S-662 00 Åmål, Sweden

[21] Appl. No.: 952,741

[22] PCT Filed: May 27, 1991

[86] PCT No.: PCT/SE91/00373

§ 371 Date: Jan. 28, 1993

§ 102(e) Date: Jan. 28, 1993

[87] PCT Pub. No.: WO91/19055

PCT Pub. Date: Dec. 12, 1991

[30] Foreign Application Priority Data

May 30, 1990 [SE] Sweden ..... 9001934

[51] Int. Cl.[6] ..... E02D 27/00; E04G 21/12

[52] U.S. Cl. ..... 52/741.1; 52/169.8

[58] Field of Search ..... 52/741.1, 295, 438–442, 52/259, 169.1, 169.8, 742, 274, 742, 169.8; 404/3

[56] References Cited

U.S. PATENT DOCUMENTS

| | | | |
|---|---|---|---|
| 895,243 | 8/1908 | Davis | 404/3 |
| 1,849,421 | 3/1932 | Dyer | 404/3 |
| 4,736,554 | 4/1988 | Tyler | 52/295 |

FOREIGN PATENT DOCUMENTS

| | | | |
|---|---|---|---|
| 1006748 | 1/1952 | France | 52/259 |
| 812829 | 9/1951 | Germany | 52/259 |
| 424667 | 8/1947 | Italy | 52/259 |
| 466788 | of 1951 | Italy | 52/259 |

OTHER PUBLICATIONS

Zenczykowski, W., "Budownictwo Ogolne", tom 3/1, Arkady 1987, p. 286, drawing 4–21.

Urban, L., "Murarstwo i tynkarstow", WSiP Warszawa 1986, p. 354.

"Biuletyn Urzedu Patentowego", Warzawa 1981, Nr 18 (202), E02D, P.222210.

*Primary Examiner*—James L. Ridgill, Jr.

*Attorney, Agent, or Firm*—Cushman Darby & Cushman

[57] ABSTRACT

A method of erecting a foundation structure for a building substructure, in which joists including a horizontal web interconnecting upright side flanges on either side, are positioned butt end against butt end and are fixed in position at a distance of a few centimeters above a substratum. Gravel, macadam or other back fill material is then positioned against the external face of each side flange, whereupon concrete is poured into the joists and is allowed to partly flow downwards, through apertures formed in the joist webs, and onto the substratum.

5 Claims, 3 Drawing Sheets

METHOD OF ERECTING A FOUNDATION STRUCTURE FOR A BUILDING SUBSTRUCTURE

BACKGROUND OF THE INVENTION

The subject invention concerns a method of erecting a foundation structure for a building substructure.

In erecting concrete building substructures, in situ casting is the procedure most commonly used today. The use of finished, prefabricated beams that are delivered to the building site, is justified only when the building project is a large one and the resources in terms of economy, machinery and personnel are ample from the start. Otherwise, i.e. in the case of building projects of small or medium size, the use of such beams involves highly specialized equipment, such as specialty vehicles, to transport the beams to the building site and, on the building site, hoisting cranes having a considerable lifting capacity, all of which is considered to be too expensive.

Also in situ casting, however, involves working processes that are complicated in several respects but have long been used, in the absence of better alternatives. For instance, following the excavation to accommodate the the building substructure, and deposition of a bed of gravel or macadam, a team of carpenters is called upon to set out and erect on the bed the forms necessary for the casting of the foundation beams. After completion of the casting operation and setting of the concrete, the team of carpenters has to return to the building site to remove the beam forms. Very often, the dismantled forms cannot be re-used. Some of the casting costs thus are consumed by the used-up form timber. An added complication is that workers of several different categories, such as excavator operators, carpenters, and concrete casters, must intervene alternatingly in the working process. The risk for unnecessary delays thus is considerable, resulting in increased costs.

In accordance with the teachings of the invention a method has been developed by means of which the work involved in erecting a foundation structure for a building substructure is highly facilitated.

BRIEF DESCRIPTION OF THE DRAWINGS

The invention will be described in closer detail in the following with reference to the accompanying drawings, wherein.

DETAILED DESCRIPTION

Figure 1:
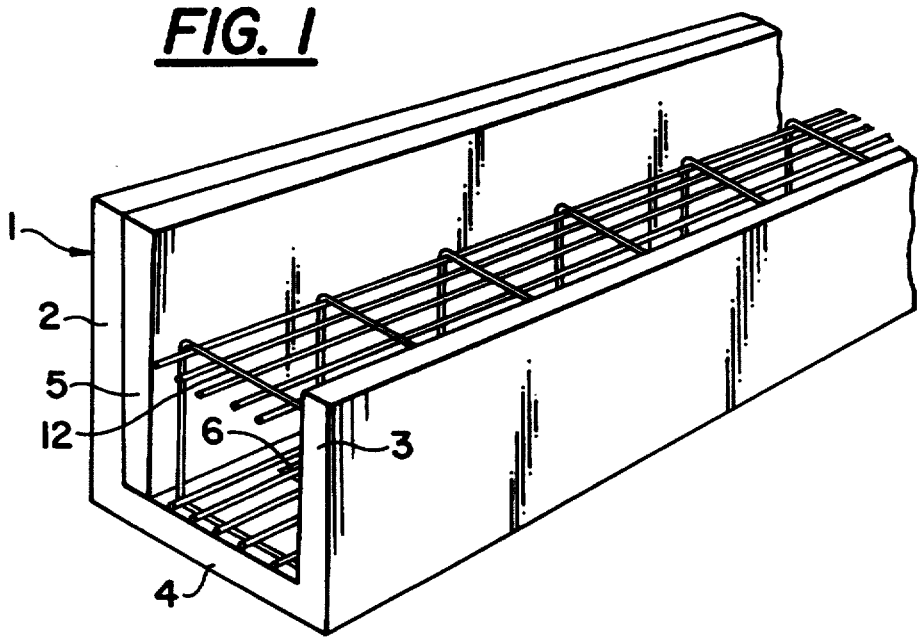
FIG. 1 is a perspective view of a shuttering joist as seen obliquely from above.
Figure 2:
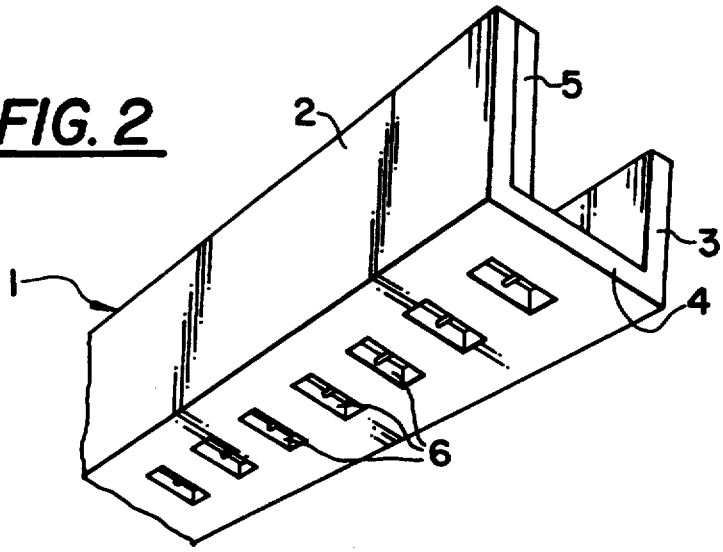
FIG. 2 is a perspective view of the same joist as seen obliquely from below.
Figure 3:
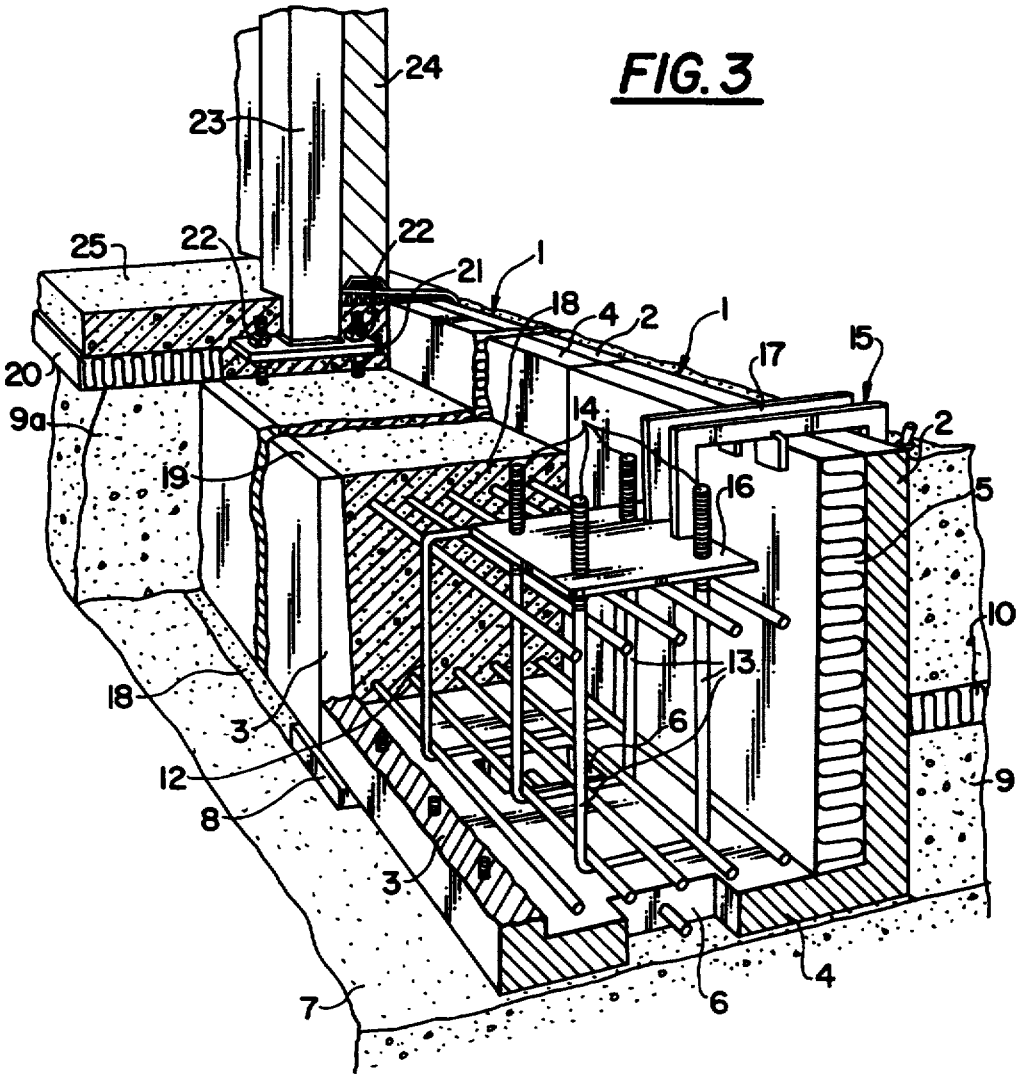
FIG. 3 is a perspective broken view showing different stages of erecting a building foundation.

The shuttering joist 1 that is used in connection with the method in accordance with the invention consists of two upright, mutually parallel side flanges 2 and 3 of concrete, and of a web 4 of concrete, interconnecting the side flanges at the bottom thereof. Side flange 2 is slightly higher than side flange 3 and its inner face is covered with an insulating layer 5. The web is formed with a number of apertures 6, the function of which will be explained in the following. Shuttering joists 1 of this configuration are prefabricated in a factory and are transported to the building site.

When shuttering joists 1 arrive at the building site the excavation work is already completed and a bed 7 of gravel has been laid and, preferably, has been compacted. On top of the bed 7 of gravel, slabs 8 of concrete are positioned, spaced apart by a distance equalling the length of the shuttering joist. The thickness of the slabs 8 preferably is 5–7 cm. The shuttering joists 1 thereafter are lowered onto the bed so as to be positioned butt end against butt end on top of the slabs 8 and in such a manner that a slight gap is left between the joist webs 4 and the bed 7 of gravel. The shuttering joists 1 are placed in such positions that the higher side flange 2 comprising the layer of insulating material 5 will form the external wall of the building foundation.

The shuttering joists 1 thus set out are secured in position by back fill material that is placed against the external face of the side flange 2. This back fill material, which preferably consists of gravel or macadam 9, is supplied in sufficient amounts for the material to reach the upper edges of the side flanges 2, in addition to which the space separating oppositely positioned external faces of the inner side flanges 3 or such external faces thereof that form an angle is likewise filled with back fill material **9*a* up to the level of the upper edges 19 of the side flanges 3. In this stage, horizontal insulating frost-protection layers 10** are also laid out.

Prefabricated reinforcement cages 12 are then placed in the shuttering joists 1 thus set out. At the same time, fastening elements 13 are inserted in the joists 1, these fastening elements 13 consisting, in accordance with the embodiment illustrated, of U-shaped iron rods the upwardly directed ends 14 of which are threaded. On top of the iron rod ends 14 are applied a fixing element 15 consisting of an apertured plate 16 which is attached to a clamping yoke 17 by means of which the plate is passed over the threaded rod ends 14. The clamping yoke 17 is clamped in position about the side flange 2 and the insulating layer 5 and thus retains the plate 16 at a predetermined level, while at the same time the latter fixes the threaded ends 14 of the fastening elements (13) in predetermined spaced-apart positions.

The shuttering joists 1 are then filled with concrete 18. Preferably so called easy-flow concrete is used which is more adaptable than conventional concrete. In the course of the successive filling of the joist with concrete, some of the concrete 18 will penetrate through the apertures 6 formed in the joist web 4 and continue onto the bed 7 of gravel. In this manner, the concrete 18 will fill out the gap between the joist web 4 and the bed 7 of gravel and even to some extent penetrate into the bed.

Concrete 18 is filled up to the level of the upper edge 19 of the inner side flange 3 and is subjected to a vibration treatment. This level is positioned somewhat below that of the plate 16. As soon as the concrete 18 has set, an insulating layer 20 is positioned on top of the bed **9*a* of gravel or macadam and in such a manner that it projects above the upper edges 19 of the side flanges 3, whereupon the fixing element 15 is loosened and removed together with the plate 16. Another plate 21 is passed over the threaded ends 14 of the fastening elements 13 and is secured in position by means of nuts 22. This plate 21 serves as an attachment means for securement of those structural components that are to project above the building foundation, such as a steel column 23** which is welded to the plate 21 and to which column wall elements 24 are thereafter secured.

When columns 23 of this kind as well as other structural components have been put in place, a vault 25 is cast on top of the insulating layer 20, up to the level of the upper edges of the outer side flanges 2. The construction of the building foundation is now completed.

Figure 4:
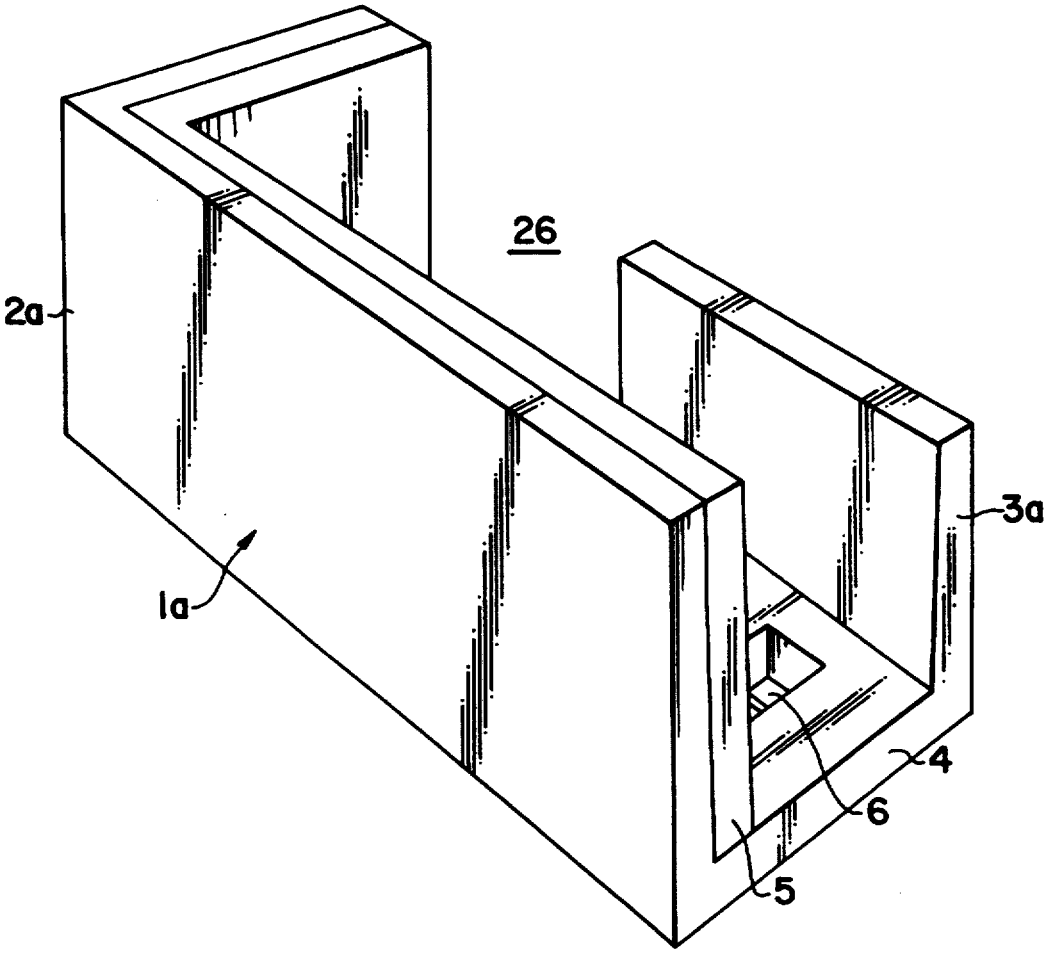
FIG. 4 is a perspective view as seen obliquely from above of a modified embodiment of the shuttering joist.

FIG. 4 illustrates a shuttering joist 1*a* of a particular configuration, comprising an outer side flange 2*a* including an angular section, a shorter side flange 3*a* and an inter-flange space 26. This joist 1*a* is intended for application in a corner of the building foundation and in all other respects it is used and functions in the same manner as the straight joists 1.

The method in accordance with the invention offers considerable advantages. compared with solid cast concrete beams the shuttering joist 1, 1*a* is relatively lightweight and consequently it is more convenient to transport it from the factory to the building site. On the building site, a building foundation may be erected in a more rational manner when the shuttering joist 1, 1*a* is used than is the case with conventional technology methods. All work connected with the setting out of forms has become superfluous. Instead, the joist 1, 1*a* in itself serves as forms. Consequently, once the casting work is completed, there is not either any dismantling of forms which needs to be done. The shuttering joist 1, 1*a*, when in its operative position as indicated, is a perfect bearing beam and it is well anchored to the supporting layer owing to concrete being allowed to penetrate through the apertures 16, which to some extent binds the joists 1, 1*a* to the supporting layer. Also the application of the insulating layer 5 at the stage of manufacture in the factory, facilitates the erection procedure compared to the work involved in applying this layer internally of a wall of a form that is to be dismantled later on. The attachment members, such as the plate 21, are embedded into the concrete 18, protected against corrosion.

Another, very essential advantage inherent in the novel method is that the preparation of the ground prior to the casting, by applying back fill materials, such as gravel or macadam 9, 9*a*, will be completed at a very early stage. The contractor responsible for the preparation of the ground thus will have finished his or her work when the building contractor starts his or her, and vehicles for supply of concrete as well as of the various building components may drive up to a position close to the building foundation, which facilitates unloading operations and all work connected with the erection of the building.

Yet another advantage is that the walls and the roof may be erected at such an early stage that the vault 25 may be cast under weather protection conditions without the need for any separate measures having to be taken for this purpose.

Research has shown that in erecting a building foundation comprising an area of approximately 1000 $m^2$, a gain of 2–2.5 weeks is obtained compared with the time required to erect a building foundation of this size, using conventional building technology. It is easily understood that considerable economical gains may be made. Furthermore, one has found that the consumption of concrete 18 is reduced, which is attributed to the possibility to carry out the casting operations under more controlled conditions.

The invention is not limited to the embodiment as illustrated and described but a number of modifications are possible within the scope of the appended claims. Obviously, the joist 1, 1*a* may be given a different shape than the one illustrated and could also be adapted to allow embedment in the concrete 18 of a large number of various structural components. Also the reinforcement 12 could be given a different configuration.

Should one wish to use a wooden pillar instead of the steel column 23, angle irons or plates are welded to the plate 21 so as to extend upwards, through the cast vault 25. Wooden pillars are then placed between the angle irons or plates, and threaded bolts are inserted through holes in the wooden pillar and the angle irons or plates, whereupon nuts are tightened on the bolts.

Alternatively, the back fill material 9*a* could be applied against the outer face of the side flange 3 only to a level allowing the insulating layer 20 to reach the upper edge 19 of the side flange 3 in cases when one wishes to cast a vault 25 having a thickness exceeding that shown.

I claim:

1. A method for erecting a foundation structure for a building substructure, comprising:

(a) in an excavation having a bed of particulate substratum material having an upper surface that is porous to wet concrete, laying out an array of preformed joists each having two transversely spaced mutually parallel upright, longitudinally extending side flanges integrally interconnected at respective bottoms thereof by a horizontal web having a series of longitudinally spaced apertures formed vertically therethrough, on respective supports, so that said joists are disposed butt end to butt end within said array, with said webs thereof spaced above said upper surface of said particulate substratum material;

(b) backfilling particulate backfill material against said both of said side flanges of each said joist from outside of each said joist;

(c) pouring wet concrete into said array of joists from above, between said side flanges of respective ones of said joists, so that some of said wet concrete flows down through said apertures and into said bed of particulate substratum material, and so as to fill upwardly open space defined within said joists up to an upper edge of at least one of said side flanges of each said joist, thereby uniting said joists of said array, and providing concrete supports for said joists from said bed at respective ones of said apertures; and (d) allowing said wet concrete to set.

2. The method of claim 1, further comprising: before conducting step (c), positioning fastening elements within said array, so as to project upwardly beyond at least one said side flange of each said joist, so that as steps (c) and (d) are conducted, upwardly protruding end portions of said fastening elements remain exposed above said concrete, to provide sites for securement of building constructional elements to said foundation structure.

3. The method of claim 1, wherein:

on each said joist, one said side flange is arranged in said array so as to be an outer side flange relative to said excavation, and the other said side flange is arranged so as to be an inner side flange; each said outer flange has an upper edge which is disposed at a higher level than an upper edge of the respective inner flange of the same said joist; and in step (c), wet concrete is poured up to said upper edge of said inner side flanges.

4. The method of claim 3, further comprising:

(e) after step (d), supporting a layer of thermal insulation on said backfill material which, within said array, has been backfilled against said inner side flanges in step (b); and (f) pouring an integral layer of wet concrete onto said layer of thermal insulation material and onto said concrete poured and set in steps (c) and (d); and (g) allowing said layer of wet concrete to set, thereby providing a cast vault of concrete.

5. The method of claim 4, wherein:

in conducting step (f), said layer of concrete is poured up to said upper edges of said outer side flanges of said joists.

* * * * *